US005921645A

United States Patent [19]

Lapi

[11] Patent Number: 5,921,645

[45] Date of Patent: Jul. 13, 1999

[54] RESIDENTIAL FIRE EQUIPMENT CABINET AND METHOD

[76] Inventor: John A. Lapi, 1879 Nob Hill Dr., Running Springs, Calif. 92382

[21] Appl. No.: 08/863,922

[22] Filed: May 27, 1997

[51] Int. Cl.[6] ..... A62C 39/00

[52] U.S. Cl. ..... 312/245; 312/242; 312/351; 49/397; 206/446; 206/486; 206/397

[58] Field of Search ..... 169/51; 220/477; 206/446, 320, 486; 49/397, 460; 312/242, 245, 248, 246, 326, 329, 114, 138.1, 351

[56] References Cited

U.S. PATENT DOCUMENTS

| | | | |
|---|---|---|---|
| D. 195,332 | 6/1963 | Hattenhauer . | |
| D. 220,762 | 5/1971 | Dial et al. . | |
| D. 225,162 | 11/1972 | Blendl . | |
| D. 250,377 | 11/1978 | Dooley et al. . | |
| D. 251,464 | 4/1979 | Masters . | |
| D. 257,091 | 9/1980 | Crosbie, Sr. . | |
| D. 259,160 | 5/1981 | Crosbie, Sr. . | |
| 1,488,965 | 4/1924 | Wicker | 312/351 X |
| 1,952,686 | 3/1934 | Sakier | 312/326 X |
| 2,347,985 | 5/1944 | Beersman | 312/351 X |
| 2,596,706 | 5/1952 | McClure | 312/329 |
| 2,752,217 | 6/1956 | Simon | 312/351 X |
| 2,842,420 | 7/1958 | Hansen et al. | 312/348.6 |
| 3,067,822 | 12/1962 | Hattenhauer . | |
| 3,220,791 | 11/1965 | Pokryfke et al. . | |
| 3,455,059 | 7/1969 | Evans | 49/397 |
| 3,942,669 | 3/1976 | Savage, Jr. | 312/245 X |
| 4,017,133 | 4/1977 | Sigler . | |
| 4,034,697 | 7/1977 | Russell . | |
| 4,046,439 | 9/1977 | Lee . | |
| 4,125,300 | 11/1978 | Putt et al. | 312/351 |
| 4,353,464 | 10/1982 | Bentler | 206/446 X |
| 4,586,762 | 5/1986 | Kennedy et al. | 49/460 X |
| 4,763,732 | 8/1988 | Neal . | |
| 4,766,292 | 8/1988 | Cone | 312/329 X |
| 4,998,587 | 3/1991 | Thomas . | |
| 5,476,318 | 12/1995 | Yingst et al. | 312/405 |

*Primary Examiner*—Peter M. Cuomo
*Assistant Examiner*—Janet M. Wilkens
*Attorney, Agent, or Firm*—John S. Christopher

[57] ABSTRACT

A residential fire equipment cabinet and method therefore typically employed in a residence or other habitable structure for storing emergency fire equipment including at least one standard size fire extinguisher container is disclosed. The fire equipment cabinet includes a construction incorporating a plurality of features including a box-shaped enclosure for housing the emergency fire equipment. The enclosure includes a top portion, an elevated base portion, a back portion and a pair of parallel side portions. A first arcuate-shaped door is provided for sealing the enclosure and includes a mechanism for rotatively attaching the first arcuate-shaped door to the front of the enclosure. Finally, at least a first recessed cavity is formed within the elevated base portion for securing a fire extinguisher container within the enclosure. In an alternative embodiment, the box-shaped enclosure which houses the emergency fire equipment includes an upper section and a lower section each including a top, a base, a common back wall and a common pair of parallel sides. Both the upper and lower sections include a separate arcuate-shaped door and a mechanism for rotatively attaching the doors to the respective sections of the enclosure. The base of the upper section includes a first recessed cavity for securing a fire extinguisher container and at least a second recessed cavity for securing a flashlight within the enclosure.

6 Claims, 5 Drawing Sheets

RESIDENTIAL FIRE EQUIPMENT CABINET AND METHOD

BACKGROUND OF THE INVENTION

1. Field of the Invention

The present invention relates to emergency fire equipment for use in a residence. More specifically, the present invention relates to methods and apparatus for an in-residence fire equipment cabinet having an arcuate-shaped plastic door and at least a pair of recessed floor cavities to support and enclose a fire extinguisher and a flashlight and, in an alternative embodiment, a lower cabinet section for storing additional emergency equipment.

2. Description of the Related Art

Fire equipment cabinets of the prior art are typically designed for commercial applications and are either surface mounted on a vertical wall or stanchion or recess mounted within a vertical wall. The fire equipment cabinets of the prior art are primarily designed to house only a single fire extinguisher and thus are actually fire extinguisher cabinets.

Many of the fire extinguisher cabinets of the prior art, whether they be wall mounted or surface mounted, include an enclosure having a transparent front surface or window. The window assists a user to determine if a fire extinguisher is actually located within the extinguisher cabinet. The transparent front surface or window may be mounted within a door that provides access to the extinguisher cabinet. The door may include a mechanism which enables the door to be opened and closed by rotating about a hinge, or by sliding or revolving within a bounded pathway. In the alternative, the transparent front surface or window is not mounted in a door which can be opened and closed. Thus, the window is fixed in position.

Many of the fire extinguisher cabinets of the prior art which include a door utilized to access the fire extinguisher also include a locking device on the door. Thus, fire extinguisher cabinets of the prior art which include locked doors or a transparent front surface or window fixed in position are designed to restrict access to the fire extinguisher. This is the case since the door must be unlocked or the window must be removed (as by shattering) to enable access to the fire extinguisher. In any case, access to the fire extinguisher is delayed and in many cases can be dangerous because of the presence of broken glass.

In many of the prior art extinguisher cabinets, access to the fire extinguisher is delayed or made inconvenient to discourage theft of or vandalism to the fire extinguisher. This is a characteristic of fire extinguisher cabinets designed for commercial or public use applications. Other fire extinguisher cabinets have been known which utilize a non-locking attachment means for sealing the door to the cabinet enclosure. Thus, the door can be opened and the fire extinguisher removed for unauthorized use. In other extinguisher cabinets known in the prior art, once the door is removed it cannot be replaced.

A deficiency shared by fire extinguisher cabinets of the prior art is that they have limited storage capacity. The extinguisher cabinet is limited to a volume which accommodates only the fire extinguisher and can not be utilized for storage of other emergency equipment. Further, the fire extinguisher cabinets of the prior art tend to be fashioned from metal and glass and thus are heavy, bulky, clumsy and thus are difficult to install. Additionally, special reinforcement of the vertical wall upon which the fire extinguisher cabinets of the prior art are mounted may be required to support the weight of the cabinet since the cabinets are not always sized to match the standard width dimension between construction studs.

Finally, fire extinguisher cabinets of the prior art tend to exhibit an appearance which is not attractive. The commercial type fire extinguisher cabinet typically comprises a box-shaped enclosure including a transparent front surface or window and/or a locked door. This construction is not aesthetically pleasing. Thus, the designs of the prior art fire extinguisher cabinets are neither mechanically suitable nor aesthetically acceptable for use in a residential environment.

Thus, there is a need in the art for an improvement in fire equipment cabinets which are utilized for storing fire equipment useful during an emergency in a residence where the cabinet exhibits improved accessibility, a large storage capacity, lightweight construction for simplifying installation, an aesthetic design for in-residence usage, and is simple to locate during an emergency.

SUMMARY OF THE INVENTION

Briefly, and in general terms, the present invention provides a new and improved residential fire equipment cabinet and method therefore embodying a novel apparatus for conveniently storing emergency fire equipment within a residence wherein the apparatus includes a plurality of features designed to assist in the identification of and access to the cabinet and the stabilization of the emergency equipment stored therein.

The present invention is generally directed to a residential fire equipment cabinet and method therefore and is typically employed in a residence or other habitable structure for storing emergency fire equipment including at least one standard size fire extinguisher container. In its most fundamental embodiment, the residential fire equipment cabinet comprises a construction incorporating a plurality of features including a box-shaped enclosure for housing the emergency fire equipment. The enclosure includes a top portion, an elevated base portion, a back portion and a pair of parallel side portions. A first arcuate-shaped door is provided for sealing the enclosure and includes a mechanism for rotatively attaching the first arcuate-shaped door to the front of the enclosure. Finally, at least a first recessed cavity is formed within the elevated base portion for securing a fire extinguisher container within the enclosure.

In a preferred embodiment, the cabinet is recessed mounted within a vertical wall. The first arcuate-shaped door is bowed outward beyond the plane of the wall surface to increase the volume of the cabinet for accommodating the fire extinguisher container and to serve to indicate by touch the location of the cabinet within the wall. The first arcuate-shaped door also includes a recessed finger grip for opening and closing the door. The elevated base portion also includes at least a second recessed cavity for securing a flashlight within the enclosure.

In an alternative embodiment, the box-shaped enclosure which houses the emergency fire equipment includes an upper section and a lower section each including a top, a base, a common back wall and a common pair of parallel sides. Both the upper and lower sections include a separate arcuate-shaped door and a mechanism for rotatively attaching the doors to the respective sections of the enclosure. The base of the upper section includes a first recessed cavity for securing a fire extinguisher container and at least a second recessed cavity for securing a flashlight within the enclosure.

These and other objects and advantages of the present invention will become apparent from the following more detailed description, taken in conjunction with the accompanying drawings which illustrate the invention, by way of example.

DESCRIPTION OF THE INVENTION

Figure 1:
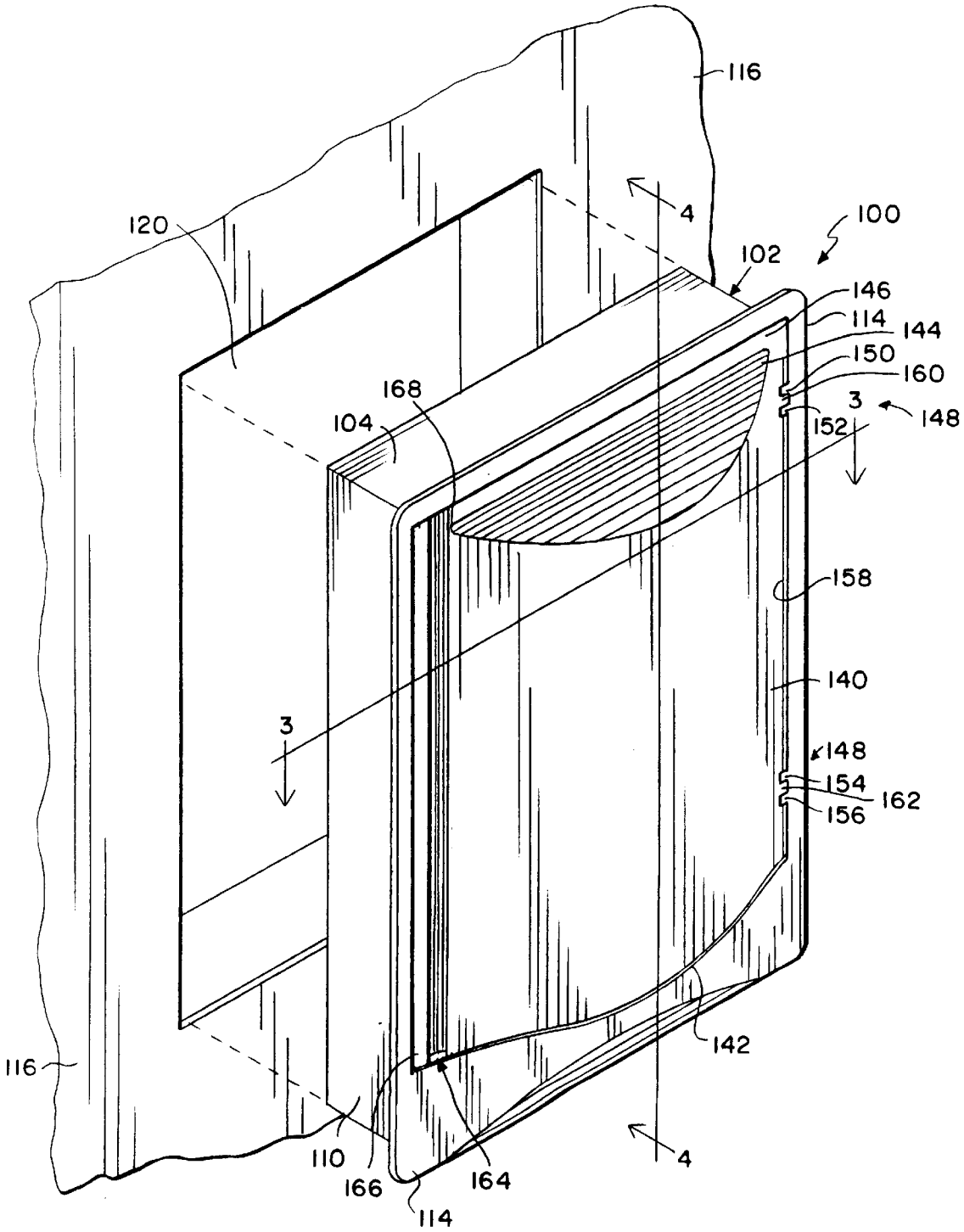
FIG. 1 is a perspective view of a preferred embodiment of the residential fire equipment cabinet of the present invention shown with the access door closed and separated from the wall mounting surface.
Figure 2:
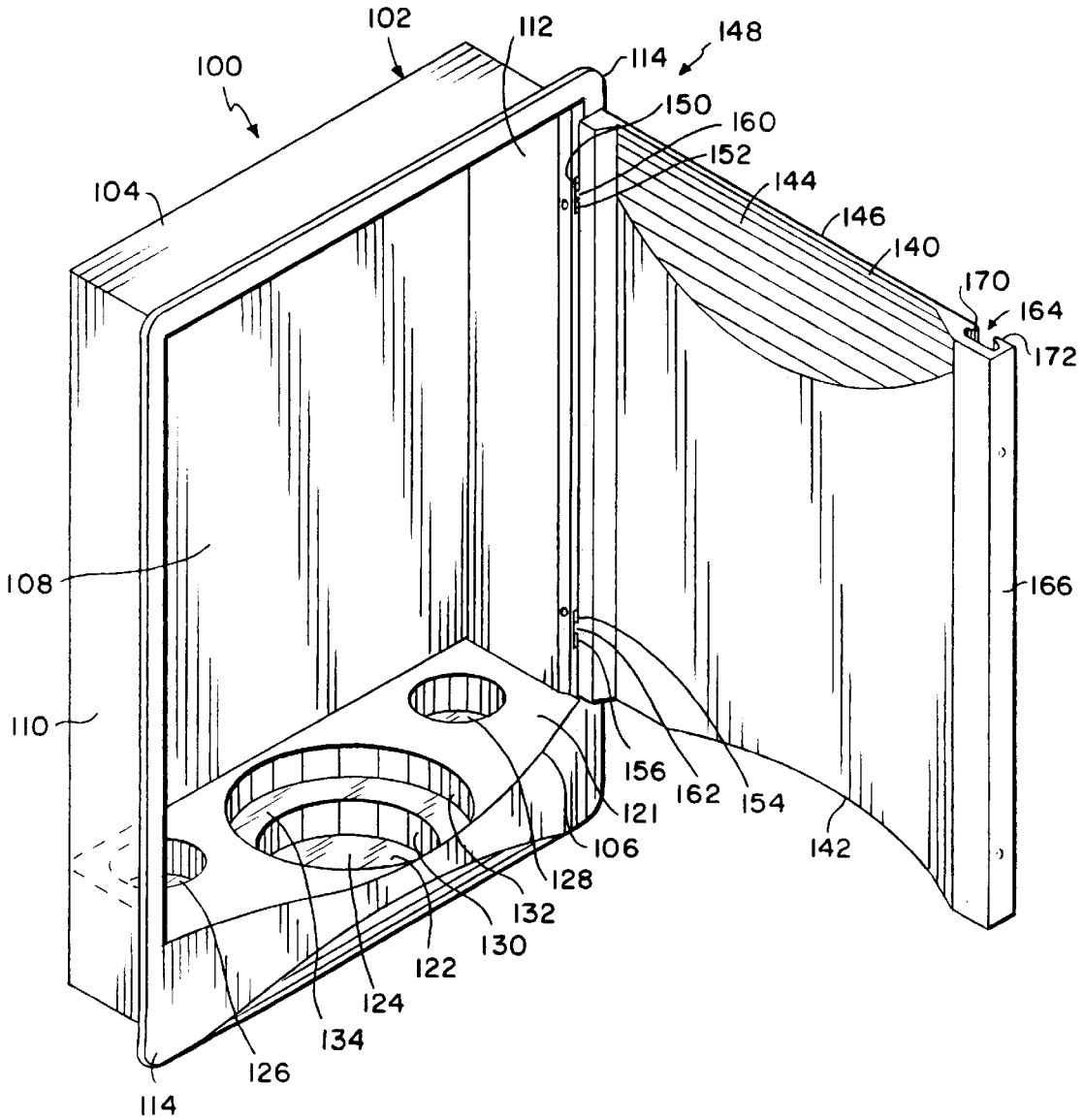
FIG. 2 is a second perspective view of the residential fire equipment cabinet of the preferred embodiment of FIG. 1 shown with the access door open for exposing the interior of the cabinet.

The present invention is a residential fire equipment cabinet 100 for housing emergency fire equipment and method therefore as shown in FIGS. 1 and 2. The present invention serves as a storage center for physical equipment useful during an emergency situation such as a fire or an earthquake. The fire equipment cabinet 100 is typically employed in a residence or other habitable structure by recess mounting within a vertical wall in a manner such that the location of the cabinet 100 can be located by touch, particularly during an emergency.

The fire equipment cabinet 100 shown in FIG. 1 comprises a low profile construction and includes a box-shaped enclosure 102 having a top portion 104, an elevated base portion 106, a back portion 108 and a pair of parallel side portions 110 and 112, respectively. The box-shaped enclosure 102 also includes a flange 114 formed about the circumference of the box-shaped enclosure 102 on the open side of the enclosure 102 opposite the back portion 108. The flange 114 enables the enclosure 102 to be recess mounted within a vertical wall 116 (shown in FIG. 1) between a pair of framing studs 118 (shown in FIG. 3) in residential as well as multi-family and commercial buildings.

In FIG. 1, the fire equipment cabinet 100 is shown separated from the vertical wall 116 within which it is recessed mounted. When the fire equipment cabinet 100 is recess mounted, the flange 114 hides the opening 120 formed within the vertical wall 116 into which the fire equipment cabinet 100 is received. The box-shaped enclosure 102 is preferably fabricated from heavy gauge polyvinyl chloride (PVC) to provide a lightweight, high strength enclosure necessary to support the emergency equipment stored within the residential fire equipment cabinet 100. Thus, the top portion 104, elevated base portion 106, back portion 108, each of the pair of parallel side portions 110 and 112, and the flange 114 are each fashioned from PVC. However, other lightweight, high strength materials could be substituted for PVC, if desired.

Figure 3:
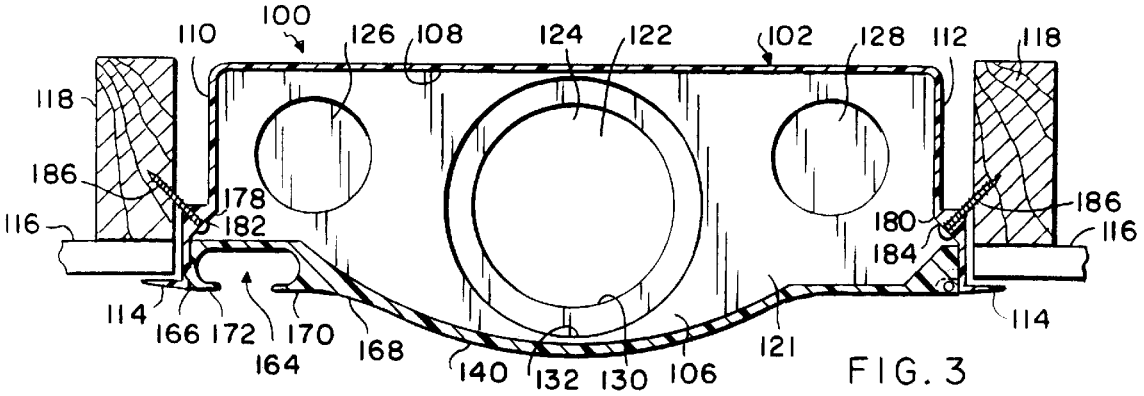
FIG. 3 is a horizontal cross-sectional view of the residential fire equipment cabinet taken along line 3—3 of FIG. 1 showing a planar view of the base section of the cabinet including the recessed floor cavities.
Figure 4:
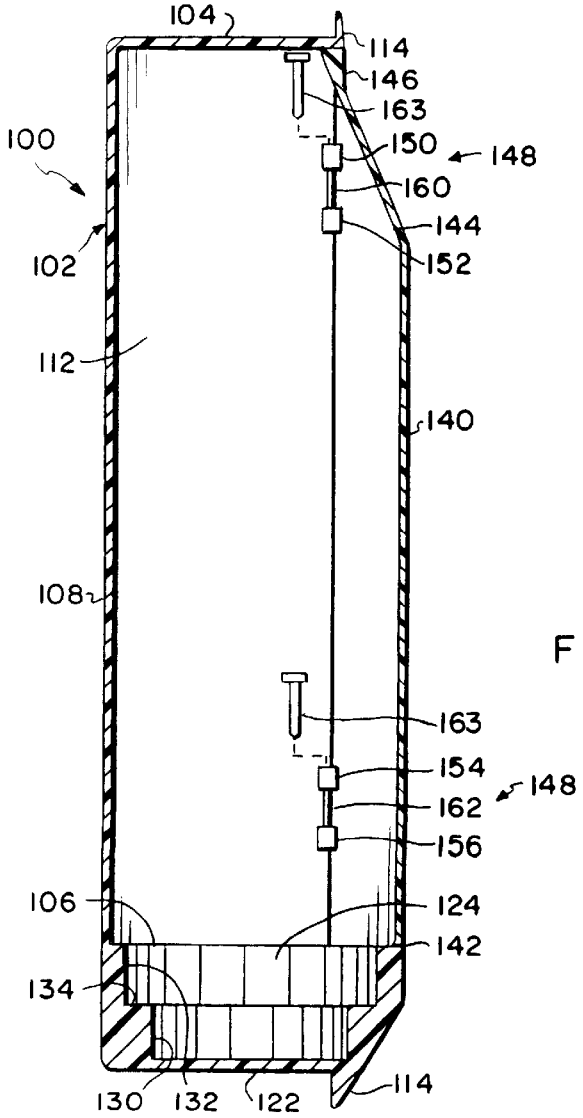
FIG. 4 is a vertical cross-sectional view of the residential fire equipment cabinet taken along line 4—4 of FIG. 1 showing the construction of a recessed floor cavity within the base section of the cabinet.

The elevated base portion 106 is clearly shown in the perspective view of FIG. 2 and also in the cross-sectional views of FIGS. 3 and 4. The elevated base portion 106 includes a base portion upper surface 101 a bottom surface 122 (shown best in FIG. 4) which is integral with the back portion 108 and the parallel side portions 110 and 112. Formed within the elevated base portion 106 is a plurality of recessed cavities intended to support emergency equipment within the cabinet 100 as is best shown in FIG. 2. In the preferred embodiment, a plurality of three recessed cavities are illustrated. However, the number of recessed cavities can be modified to satisfy a particular design criteria.

In the preferred embodiment, a first recessed cavity 124 is shown in FIGS. 2 and 3. Second and third recessed cavities 126 and 128 are also shown adjacent to the first recessed cavity 124. The first recessed cavity 124 is intended to support a fire extinguisher container (not shown) in an upright manner. FIGS. 2 and 4 each illustrate that the first recessed cavity 124 exhibits a two-step graduated construction, i.e., the first recessed cavity 124 includes two bases each having different diameters. The two-step graduated construction of the first recessed cavity 124 serves two purposes. If a heavy load is placed upon a flat plastic surface, it will eventually bow, i.e., be deformed, from the heavy load. This is because a flat plastic surface has good compression but not good strength. In order to avoid the deformation, the flat plastic surface requires a plurality of vertical supports to help support the weight load.

The two-step graduated construction of the first recessed cavity 124 includes two separate vertical supports 130 and 132 which provide the two separate diameters as is shown in FIGS. 2 and 4. By virtue of this design which includes the vertical supports 130 and 132, the two-step graduations of the first recessed cavity 124 support the load of the fire extinguisher container (not shown). The two-step graduated construction is also useful since the base diameters of all fire extinguisher containers are not of a standard size. The first recessed cavity 124 can be sized for a fire extinguisher container having a specific diameter, e.g., a standard cylinder, or a non-standard size.

This is accomplished by graduating the first recessed cavity 124 in two step sizes for different size fire extinguisher containers. Thus, the lower graduation of the first recessed cavity 124 having a smaller diameter supports a smaller (and thus lighter) fire extinguisher container on bottom surface 122 as shown in FIGS. 2 and 4. However, the upper graduation of the first recessed cavity 124 having the larger diameter supports a larger (and thus heavier) fire extinguisher container on a reinforced upper ledge 134 shown best in FIG. 4. In the case of the larger diameter fire extinguisher container, the first vertical support 130 (shown best in FIG. 4) reinforces the upper ledge 134 and assists in supporting the heavier fire extinguisher container (not shown).

It is noted that the two-step construction of the first recessed cavity 124 is molded as a single PVC unit with the box-shaped enclosure 102. The gauge of the PVC utilized in the two-step graduated construction of the elevated base portion 106 is determined by the weight load of the fire extinguisher container (not shown). The second recessed cavity 126 and the third recessed cavity 128 formed in the elevated base portion 106 are not stepped but could be if desired. The cavities 126 and 128 are used to support equipment typically needed during a fire or other emergency such as a flashlight. The bottom surface 122 serves as the floor for each of the cavities 126 and 128 as shown in FIGS. 2 and 4. The flashlights are suspended in either of the cavities 126 or 128 with the end of the flashlight supported by the bottom surface 122 of the box-shaped enclosure 102.

The fire equipment cabinet 100 also includes an arcuate-shaped door 140 which is hinged to the box-shaped enclosure 102 as shown in FIGS. 1–3. The arcuate-shaped door 140 is comprised of a lighter weight, non-transparent PVC material. The arcuate-shaped door 140 is bowed outward to provide the additional volume required by a fire extinguisher container (not shown) that has a diameter greater than the width of the parallel side portions 110 and 112 of the box-shaped enclosure 102. This condition is clearly shown in FIG. 2 which illustrates the fire equipment cabinet 100 with the arcuate-shaped door 140 in the open position. As can be seen in FIG. 2, the front of the elevated base portion 106 is curved. Thus, the bottom surface 142 of the arcuate-shaped door 140 is curved so as to be congruent with the front curved surface of the elevated base portion 106. Further, the arcuate-shaped door 140 includes a flatten portion 144 and a frame interface piece 146 formed at the top of the door 140. The flatten portion 144 and the frame interface piece 146 enable the arcuate-shape of the door 140 to mate snugly with the upper part of the flange 114 as shown in FIGS. 1, 2, 4 and 5.

Although the box-shaped enclosure 102 is recessed within the vertical wall 116 (see FIG. 1), the arcuate-shaped door 140 gently rises above the surface of the vertical wall 116. Thus, the arcuate-shape of the door 140 also serves to mark the location of the fire equipment cabinet 100 by touch along the surface of the vertical wall 116 as shown in FIGS. 3 and 4. This feature is extremely important in a situation in which the fire equipment cabinet 100 is mounted in a vertical wall 116 in a hallway within a residence which is filled with smoke generated by a fire. In a contained fire, the smoke rises and the available oxygen is located near the floor surface of, for example, the residential hallway. Thus, a person crawling along the floor surface could reach upward and pass her hand along the wall surface until the arcuate-shape of the door 140 is sensed. Thereafter, she could open the door 140 and remove the fire extinguisher container and other emergency equipment therefrom for use in fighting the fire.

The arcuate-shaped door 140 is hinged to the box-shaped enclosure 102 as described hereinbelow. A door hinge mechanism 148 is comprised of components that are molded to the inside of the box-shaped enclosure 102 and to the arcuate-shaped door 140. Integrally molded to the inside of the parallel side portion 112 of the box-shaped enclosure 102 is a first pair of hinge blocks 150, 152 and a second pair of hinge blocks 154, 156 best shown in FIGS. 2 and 4. Each of the hinge blocks 150, 152, 154 and 156 includes a vertical penetration formed therethrough. Integrally molded to a door edge 158 of the arcuate-shaped door 140 is a first extension lip 160 and a second extension lip 162 as is shown in FIG. 4. Each of the extension lips 160 and 162 includes a vertical penetration formed therethrough.

Upon mounting the arcuate-shaped door 140 to the box-shaped enclosure 102, the first extension lip 160 is aligned between hinge blocks 150 and 152. Likewise, the second extension lip 162 is aligned between hinge blocks 154 and 156 best shown in FIG. 4. Once aligned, a set of pins 163 are passed through the aligned penetrations of the hinge blocks 150, 152 and extension lip 160 and through the aligned penetrations of hinge blocks 154 and 156 and extension lip 162. Thus, the arcuate-shaped door 140, which pivots about the pins 163, becomes an integral part of the box-shaped enclosure 102.

Figure 5:
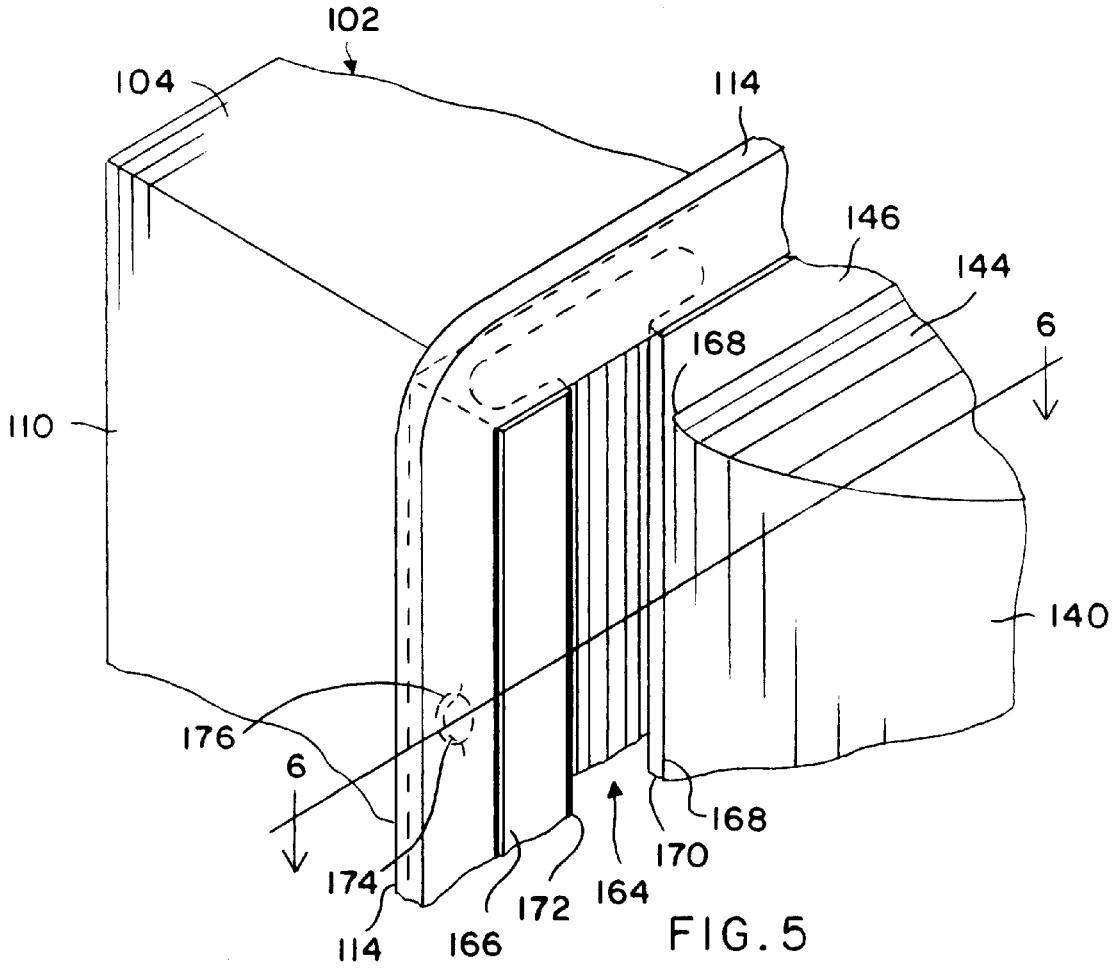
FIG. 5 is an enlarged view of the detail of the recessed door handle formed on the arcuate surface of the plastic door of FIG. 1 showing the finger grip utilized to open and close the door of the fire equipment cabinet.

The arcuate-shaped door 140 further includes a recessed finger grip 164 employed to operate the door 140 about the door hinge mechanism 148. The recessed finger grip 164 is formed adjacent to a door edge 166 during the manufacture of the arcuate-shaped door 140. The vertical bowed portion of the arcuate-shaped door 140 terminates, i.e., ends, at a point adjacent to the door hinge mechanisms 148 on the right side of the door 140 and at a point 168 on the left side of the door 140 shown best in FIGS. 1, 3 and 5. The recessed finger grip 164 is a hollow formed between the point 168 (where the left vertical bowed portion of the arcuate-shaped door 140 ends) and the left door edge 166 as shown in FIGS. 1, 3 and 5. The recessed finger grip 164 or hollow includes a first edge 170 and a second edge 172 best shown in FIG. 6. The first and second edges 170 and 172 do not close upon one another but are open to facilitate access by placing the fingers of the hand within the hollow to open and/or close the arcuate-shaped door 140 about the door hinge mechanisms 148. The recessed finger grip 164 is integrally formed with and is accessible along the entire vertical length of the plastic arcuate-shaped door 140.

Figure 6:
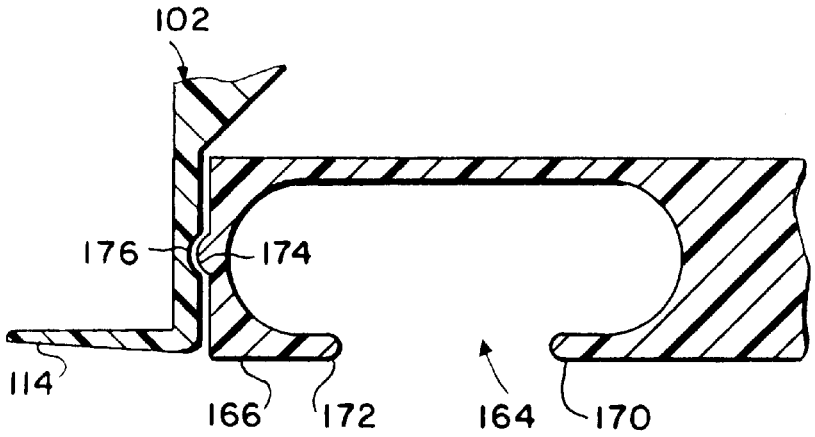
FIG. 6 is a cross-sectional view taken along line 6—6 of FIG. 5 showing the recessed door handle formed on the arcuate surface of the plastic door.

The fire equipment cabinet 100 also includes a mechanism for retaining the arcuate-shaped door 140 in a secure, closed position shown best in FIG. 6. The end of the left door edge 166 of the PVC arcuate-shaped door 140 includes a protuberance 174 formed thereon as is clearly shown in FIG. 6 and also in FIG. 5. Also, a depression 176 is formed on the inside surface of the left parallel side portion 110 of the PVC box-shaped enclosure 102. By applying mild force to the recessed finger grip 164 when closing the arcuate-shaped door 140, the plastic protuberance 174 snaps into and mates with the depression 176 to secure the door 140 in position. Likewise, a mild pulling force applied to the recessed finger grip 164 when opening the arcuate-shaped door 140 will cause the protuberance 174 to separate from the depression 176 so that the door 140 will open.

It is anticipated that the residential fire equipment cabinet 100 will be installed in new residential, multi-unit and commercial buildings. It is also foreseeable that the fire equipment cabinet 100 can be retrofitted into existing structures. This is the case since the fire equipment cabinet 100 is designed to be installed between existing 2"×4" or 2"×6" wood building studs which are typically 16" on center. Installation of the fire equipment cabinet 100 as shown in FIG. 3 is as follows. Each of the parallel side portions 110 and 112 of the box-shaped enclosure 102 include a reinforced corner 178 and 180, respectively. Each of the reinforced corners 178 and 180 include a penetration 182 and 184, respectively, formed therein to permit the passage of a fastening means 186. The fire equipment cabinet 100 is positioned adjacent to a wall block, i.e., the pair of framing studs 118. As is shown in FIG. 3, the fastening means 186 comprising threaded wood screws, nails or the like is used to secure the fire equipment cabinet 100 to the pair of framing studs 118.

Figure 7:
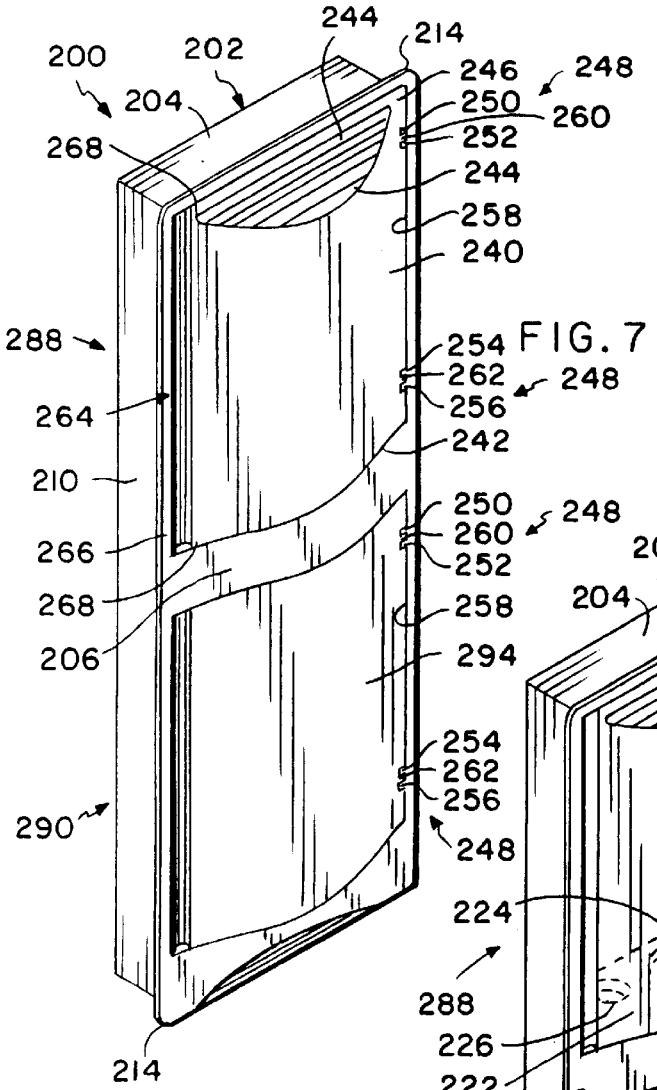
FIG. 7 is a perspective view of an alternative embodiment of the residential fire equipment cabinet of the present invention showing a closed access door to a lower section utilized for storage of emergency equipment.
Figure 8:
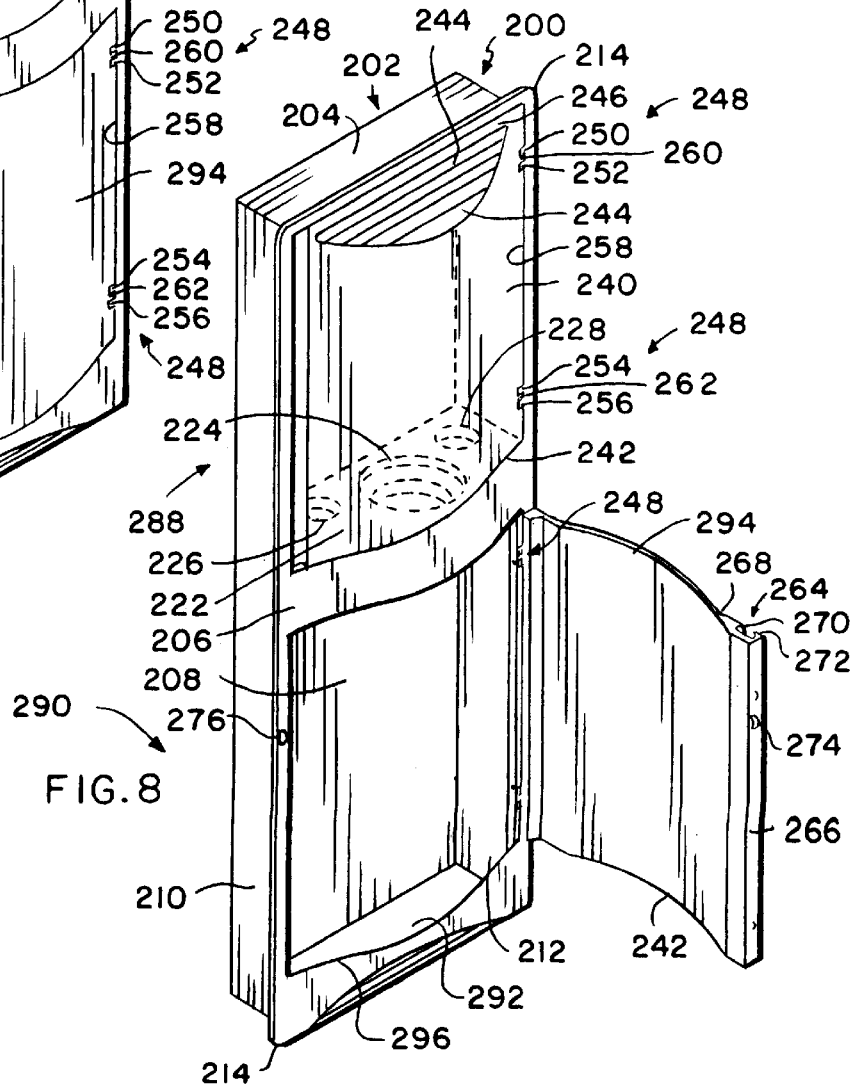
FIG. 8 is a second perspective view of the alternative embodiment of the residential fire equipment cabinet of FIG. 7 illustrating the lower section utilized for storage of emergency equipment with the access door shown open.

A first alternative embodiment of the residential fire equipment cabinet of the present invention is shown in FIGS. 7–8 and is referred to by the identification number 200. Each of the components appearing in the alternative embodiment 200 that correspond in structure and function to those components appearing in the preferred embodiment 100 is identified by the corresponding number of the 200 series.

The residential fire equipment cabinet 200 includes an upper section 288 and a lower section 290 as shown in FIGS. 7 and 8. The upper section 288 is duplicate to the fire equipment cabinet 100 described in the preferred embodiment set forth hereinabove in FIGS. 1–6. Consequently, the duplicate portions of the fire equipment cabinet will not be repeated here. Thus, the interior of the upper section 288 of the fire equipment cabinet 200 is not disclosed in FIGS. 7 and 8 since it is duplicate to that shown in FIGS. 1–6. The reader is reminded that the identification numbers for the exterior components of the upper section 288 that are shown in FIGS. 7 and 8 correspond to those of the preferred embodiment in FIGS. 1–6 except that they are expressed in the 200 series.

A feature that distinguishes the fire equipment cabinet 200 from the cabinet disclosed in FIGS. 1–6 is that the box-shaped enclosure 202 has a greater length dimension. The greater length dimension accommodates the addition of the lower section 290 mounted beneath the upper section 288 as shown in FIGS. 7–8. However, the width and depth dimensions of the box-shaped enclosure 202 will be the same as that illustrated in FIGS. 1–6 since the fire equipment cabinet 200 will be mounted in the same size stud wall as a cabinet having only a singular section.

The fire extinguisher container and flashlights will be stowed in the upper section 288 just as illustrated in FIGS. 1–6. The lower section 290 of the fire equipment cabinet 200 includes a large storage capacity for storing emergency equipment as is shown in FIG. 8. The lower section 290 shares a common back portion 208, and common parallel side portions 210 and 212 with the upper section 288 as shown in FIG. 8. The top portion of the lower section 290 (not visible) is the bottom surface 222 of the elevated base portion 206 of the upper section 288. The lower section 290 includes a base 292 which is comprised of PVC and is molded to the remainder of the box-shaped enclosure 202 to form a unitary structure.

Pivotally mounted upon a pair of hinge door mechanisms 248 shown in FIGS. 7 and 8 is a second arcuate-shaped door 294. The arcuate-shaped door 294 serves to close and seal the lower section 290 of the fire equipment cabinet 200. The construction and operation of the second arcuate-shaped door 294 of the lower section 290 is duplicate to that of the first arcuate-shaped door 240 of the upper section 288 shown in FIGS. 7 and 8. Furthermore, the construction and operation of the first arcuate-shaped door 240 of the upper section 288 is duplicate to the arcuate-shaped door described in FIGS. 1–6. Thus, the second arcuate-shaped door 294 is bowed to provide additional volume for the storage of a fire extinguisher container (not shown) that has a diameter greater than the width dimension of the parallel side portions 210 and 212. Furthermore, the arcuate shape of the door 294 serves to identify the location of the fire equipment cabinet 200 by touch in a room darkened by smoke or the absence of electrical lights.

Additionally, the second arcuate-shaped door 294 also includes a recessed finger grip 264 to facilitate operation of the door 294. Also, a protuberance 274 is molded onto the left door edge 266 which mates with a corresponding depression 276 formed in the parallel side portion 210. The protuberance 274 and the depression 276 together function to retain the second arcuate-shaped door 294 in a closed position. Both the recessed finger grip 264 and the combined protuberance 274 and depression 276 are constructed in a manner duplicate to that described in FIGS. 1–6. Further, the fire equipment cabinet 200 includes a flange 214 to assist in recess mounting the cabinet 200. Mounting the fire equipment cabinet 200 between two wall studs is accomplished in the same manner as previously described with reference to FIG. 3 by driving threaded fasteners through penetrations formed in the box-shaped enclosure 202 and into the wood studs.

The second arcuate-shaped door 294 is shown in the closed position in FIG. 7 and in the open position in FIG. 8. With the second arcuate-shaped door 294 pivoted open, the base 292 of the lower section 290 is visible. It can be seen in FIG. 8 that the base 292 is somewhat sunken below a bottom edge 296 of the box-shaped enclosure 202 which forms a pocket area useful for stowing a collapsible (folding) ladder. The remainder of the lower section 290 can be utilized to stow additional emergency equipment such as a first aid kit, radio, batteries, water, supplies, canned food, tools, ax, hammer, repair kit and the like. Mounting clamps, hooks and the like can be attached to the common back portion 208 and the parallel side portions 210 and 212 if so desired to assist in stowing the various items of emergency equipment.

It is also noted that the residential fire equipment cabinet 200 shown on FIGS. 7 and 8 also includes a top portion 204, a first recessed cavity 224 of the elevated portion 206, a second recessed cavity 226 of the elevated portion 206, a third recessed cavity 228 of the elevated base portion 206, a bottom curved surface 242 of the first arcuate-shaped door 240, a flattened portion 244 of the door 240, a frame interface piece 246, a first pair of hinge blocks 250 and 252, a second pair of hinge blocks 254 and 256, a door edge 258 of the door 240, a first extension lip 260 of the door 240, a second extension lip 262 of the door 240, a point designated 268 indicating the furthest left edge of the arcuate-shaped door 240, a first edge 270 of the recessed finger grip 264 and a second edge 272 of the recessed finger grip 264.

The present invention provides novel advantages over other fire equipment cabinets known in the art. The main advantages associated with the fire equipment cabinet of the present invention include improved accessibility to the cabinet by eliminating the necessity to break glass or remove a locking device, the ability to locate the cabinet by touch during an emergency such as in a smokey fire, darkened conditions caused by an electrical power outage or the like, a large multi-functional storage capacity, lightweight plastic construction which simplifies installation, and an aesthetic design for in-residence usage.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention. Accordingly,

What is claimed is:

1. A fire equipment cabinet for use in a residence comprising:

a box-shaped plastic enclosure for housing a plurality of emergency fire equipment, said enclosure having a top portion, an elevated base portion, a back portion, a pair of parallel side portions and a flange for recess mounting said enclosure within a vertical wall;

a first plastic arcuate-shaped door for sealing said enclosure, said first arcuate-shaped door having a recessed finger grip extending the entire vertical length of said first arcuate-shaped door for opening and closing said first arcuate-shaped door;

means for rotatively attaching said first arcuate-shaped door to said enclosure;

a first recessed cavity formed within said elevated base portion for securing a fire extinguisher container within said enclosure, said first recessed cavity having a graduated two-step construction for supporting the weight of and accommodating the size of said fire extinguisher container in an upright manner;

a storage space located beneath said elevated base portion for storing emergency equipment; and a second plastic arcuate-shaped door for sealing said storage space, said second arcuate-shaped door having a recessed finger grip extending the entire vertical length of said second arcuate-shaped door for opening and closing said second arcuate-shaped door.

2. The fire equipment cabinet of claim 1 wherein said attaching means comprises a hinge formed integrally on one of said parallel side portions and on said first arcuate-shaped door, said hinge being assembled with a pin.

3. The fire equipment cabinet of claim 1 further including at least a second recessed cavity formed within said elevated base portion for securing a flashlight within said enclosure.

4. The fire equipment cabinet of claim 1 further including a plastic protuberance formed on said first arcuate-shaped door and a mating depression formed in said box-shaped enclosure for retaining said first arcuate-shaped door in a closed position.

5. A fire equipment cabinet for use in a residence comprising:

a box-shaped plastic enclosure for housing a plurality of emergency fire equipment, said enclosure having an upper section and a lower section mounted immediately beneath said upper section;

an elevated base portion separating said upper section and said lower section in said enclosure, said upper section and said lower section each including a common back wall and a common pair of parallel sides;

a first arcuate-shaped door for sealing said upper section of said enclosure;

a second arcuate-shaped door for sealing said lower section of said enclosure, said first and second arcuate-shaped doors each having a recessed finger grip extending the entire vertical length of the first and second arcuate-shaped doors, respectively;

means for rotatively attaching said first arcuate-shaped door to said upper section and said second arcuate-shaped door to said lower section; and a first recessed cavity formed within said elevated base portion for securing a fire extinguisher container within said enclosure, said first recessed cavity having a graduated two-step construction for supporting the weight of and accommodating the size of said fire extinguisher container in an upright manner.

6. A fire equipment cabinet for use in a residence comprising:

a box-shaped plastic enclosure for housing a plurality of emergency fire equipment, said enclosure having a top portion, an elevated base portion, a back portion, a pair of parallel side portions and a flange for recess mounting said enclosure within a vertical wall;

a first plastic arcuate-shaped door for sealing said enclosure, said first arcuate-shaped door having a recessed finger grip extending the entire vertical length of said first arcuate-shaped door for opening and closing said first arcuate-shaped door;

means for rotatively attaching said first arcuate-shaped door to said enclosure; and a first recessed cavity formed within said elevated base portion for securing a fire extinguisher container within said enclosure, said first recessed cavity having a graduated two-step construction including a corresponding pair of vertical supports for supporting the weight of and accommodating the size of said fire extinguisher container in an upright manner.

* * * * *